US005347941A

United States Patent [19]

Mizuno

[11] Patent Number: 5,347,941

[45] Date of Patent: Sep. 20, 1994

[54] LOOPER THREAD GUIDING MECHANISM FOR FACILITATING THE LOOPER THREAD SETTING TO A LOOPER

[75] Inventor: Yasuo Mizuno, Toki, Japan

[73] Assignee: Brother Kogyo Kabushiki Kaisha, Aichi, Japan

[21] Appl. No.: 44,499

[22] Filed: Apr. 9, 1993

[30] Foreign Application Priority Data

May 26, 1992 [JP] Japan ..... 4-133335

[51] Int. Cl.[5] ..... D05B 57/00

[52] U.S. Cl. ..... 112/199; 112/162; 112/302

[58] Field of Search ..... 112/199, 197, 162, 163, 112/165, 167, 154, 159, 202, 302, 225, 224, 166

[56] References Cited

U.S. PATENT DOCUMENTS 4,977,842 12/1990 Fukao et al. ..... 112/199
5,076,181 12/1991 Wang ..... 112/199
5,168,821 12/1992 Kamiya ..... 112/199

FOREIGN PATENT DOCUMENTS 63-240895 10/1988 Japan ..... 112/302
3-6292 2/1991 Japan .

*Primary Examiner*—Peter Nerbun
*Attorney, Agent, or Firm*—Oliff & Berridge

[57] ABSTRACT

A looper thread guiding mechanism for facilitating setting of the looper thread to a double loop looper. A drum is rotatably provided at a side portion of the looper having a thread hole at a tip end portion thereof. A thread hooking portion is slidably movably provided along the looper. The thread hooking portion is connected to the drum by a resilient linking member. By angular rotation of the drum in one direction, the thread hooking portion is positioned adjacent the thread hole for facilitating the thread setting. By angular rotation of the drum in an opposite direction, the linking member is partially wound over the drum, and the thread hooking portion is moved toward a base portion of the looper.

10 Claims, 3 Drawing Sheets

LOOPER THREAD GUIDING MECHANISM FOR FACILITATING THE LOOPER THREAD SETTING TO A LOOPER

BACKGROUND OF THE INVENTION

The present invention relates to a looper thread guiding mechanism, and more particularly, to such mechanism in which a looper thread passing through a thread hole formed at a tip end of a looper is guided to a base portion thereof in a sewing machine such as an overlock sewing machine.

In a sewing machine such as an overlock sewing machine, a looper is provided in a bed. The looper has a tip end portion formed with a looper thread hole and a base end portion provided with a thread hook or thread holding portion. Sewing operation is achievable by engaging the looper thread with the thread hook while the looper thread is passed through the thread hole. The thread hook is distant from the thread hole, and a great number of mechanical components are densely arranged around the looper. Therefore, the act of engaging the looper thread with the thread hook may extremely troublesome if the thread hook is stationarily provided.

To facilitate the looper thread engagement work, Japanese Utility Model Publication (Kokoku) No.3-6292 proposes an arm member pivotally supported to a looper arm. The arm member has a thread hook portion at its tip end, so that the looper thread engagement work is performed during displacement of the thread hook portion in the pivotal motion of the arm member.

However, according to the above proposed arrangement, a space is required around the looper for allowing the arm member to be pivotally movable. To this effect, it is necessary to overcome a spatial problem in that the positions of other components around the looper must be altered to obtain the sufficient space. Further, since great number of mechanical components are disposed around the looper, operability of the arm member may be degraded, and as a result, it would be rather difficult to fully simplify the looper thread setting work.

Particularly, in the case of the overlock sewing machine whose bed densely houses therein an overlooper, an underlooper and a double loop looper along with other components. it would be almost impossible to provide the looper thread guiding mechanism with respect to each one of the loopers due to the spatial problems.

SUMMARY OF THE INVENTION

The present invention has been established in light of the above-described drawbacks, and it is therefore, an object of the present invention to provide a looper thread guiding mechanism in a sewing machine capable of facilitating setting of a looper thread onto a looper even in a limited space around the looper with sufficient operability.

These and other objects of the present invention will be attained by providing a looper thread guiding mechanism for guiding a looper thread to a looper of a sewing machine, the looper including a base portion and an arm portion extending from the base portion and having a thread hole at its tip end portion, a stitch being formed in a workpiece by a swinging motion of the looper in synchronism with a vertical motion of a sewing needle, the mechanism comprising a movable segment, a drum and a linking member. The movable segment is slidably and substantially linearly movable along the arm portion between a thread hooking position adjacent the thread hole and a stitching position adjacent to the base portion. The movable segment has a thread holding portion. The drum is rotatably supported to the base portion and positioned away from the arm portion. The linking member is connected between the drum and the movable segment. The linking member is unwound from the drum upon angular rotation thereof in one direction for positioning the movable segment adjacent to the thread hole, and is partly wound over the drum upon angular rotation thereof in opposite direction for positioning the movable segment adjacent to the base portion so as to guide the looper thread to the base portion.

With this arrangement, by rotating the drum, the linking member slidingly moves the movable segment having the thread holding portion between the thread hooking position and the stitching position. Therefore, an operator manually rotates the drum to position the movable segment to the thread hooking position. In this state, the looper thread is inserted through the thread hole of the looper, and the thus inserted looper thread is held by the thread holding portion positioned adjacent the thread hole. Then, the drum is again rotated for moving the movable segment to the stitching position, to thereby complete setting work of the looper thread.

In this case, in the looper thread setting work, the thread holding portion is positioned adjacent to the thread hole, and accordingly, the work for holding the looper thread to the thread holding portion can be easily performed. Further, since the drum is disposed away from the looper around which a great number of mechanical components are provided, manipulation to the drum can be easily achieved because of a sufficient space around the drum. Furthermore, in a preferred embodiment, since the linking member has a web-like configuration having a small width, the linking member can be easily positioned in a limited space defined by a great number of mechanical components disposed around the looper.

DETAILED DESCRIPTION OF THE PREFERRED EMBODIMENT

A looper thread guiding mechanism according to one embodiment of the present invention will be described with reference to FIGS. 1 through 5. The following description concerns an overlock sewing machine to which the present embodiment is applied.

Figure 5:
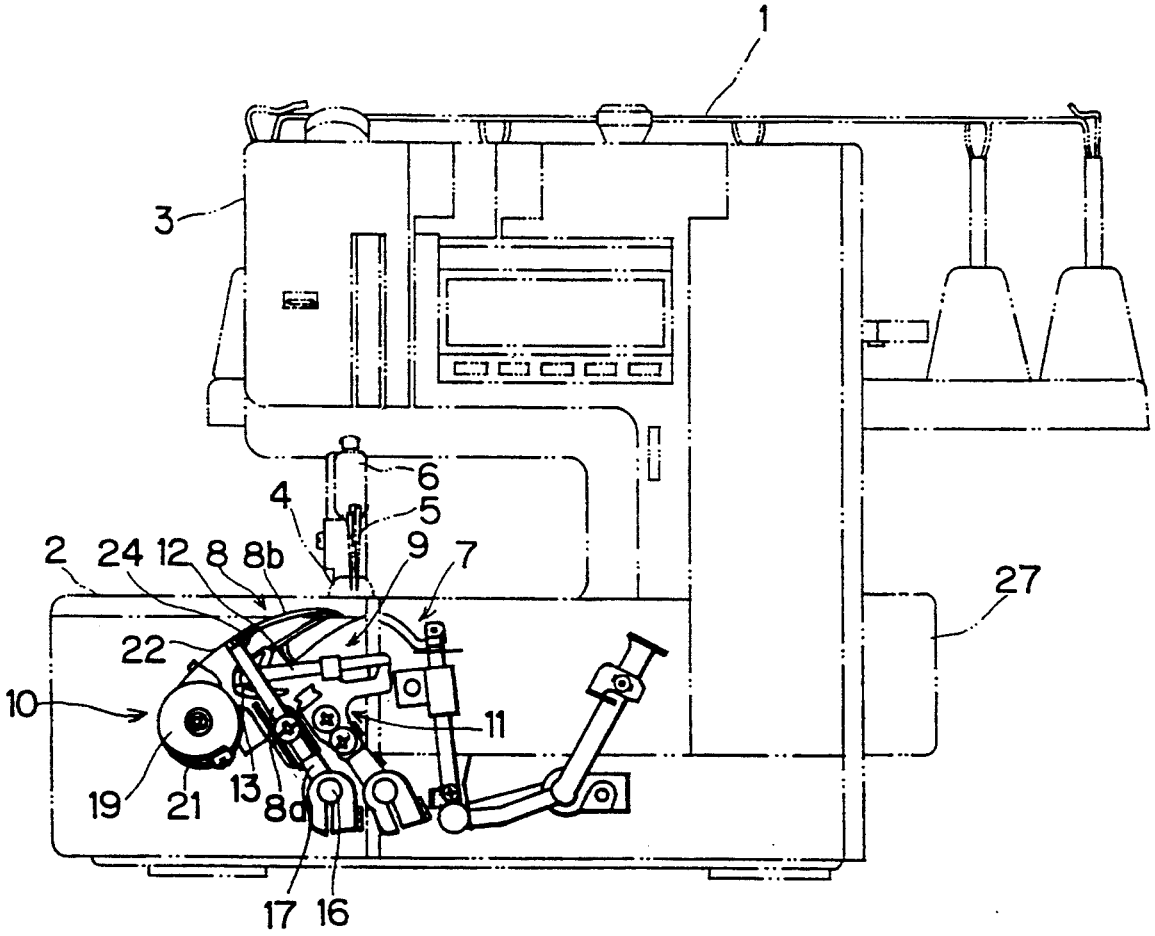
FIG. 5 is a schematic front view showing an overall arrangement of an overlock sewing machine incorporating the looper thread guiding mechanism of the present embodiment.

The overlock sewing machine includes a main body 1 having a bed 2 and an arm 3 provided integrally therewith as shown in FIG. 5. The lower portion of the arm 3 is provided with a pressure foot 4. Further, a needle bar 6 supporting three sewing needles 5 is vertically movably supported to the arm 3. Needle threads are supplied to the sewing needles 5 by way of thread tension regulators (not shown), etc.

A throat plate (not shown) is provided on an upper surface of the bed 2. The plate has holes aligned correspondingly with the three sewing needles 5 in a conventional manner. At a position below the throat plate, an overlooper 7, a double loop looper 8 and an underlooper 9 are provided. The overlooper 7 is provided at one lateral side of the throat plate, whereas the double loop looper 8 and the underlooper 9 are provided at another lateral side thereof and arranged side by side in a stitching direction. To each of the loopers 7, 8, 9, a looper thread T (see FIGS. 1 through 4) is supplied by a thread tension regulator and a looper thread take-up, etc.

A spindle (not shown) driven by a sewing machine motor (not shown) is rotatably provided within the bed 2. The rotation of the spindle is transmitted to the needle bar 6 for vertical reciprocation thereof. In synchronism with the reciprocation, each of the loopers 7, 8, 9 is swingably moved. Thus, a chain stitch is provided on a workpiece fabric placed on the throat plate.

In addition to the loopers 7, 8, 9, there is also provided in the bed 2 a fabric feeding mechanism for driving a feed dog (not shown). Thus, great numbers of mechanical components are densely disposed around these loopers 7, 8, 9. An openable front cover (not shown) is provided at a front portion of the bed 2. Further, an openable side cover (not shown) is provided at a left side (FIG.5) of the bed 2. Upon opening these covers, loopers 7, 8, 9 and associated arrangements can be observed.

The double loop looper 8 is provided with a looper thread guiding mechanism 10 according to the embodiment of this invention. On the other hand, the underlooper 9 is provided with a second thread guiding mechanism 11 different from the mechanism 10. The second thread guiding mechanism 11 includes a transfer member 13 slidably movable along a guide rail 12 integrally attached to the underlooper 9 for transferring the looper thread T. Details of the second thread guiding mechanism 11 is disclosed in U.S. Pat. No. 4,977,842, and therefore, further description can be neglected.

Figure 1:
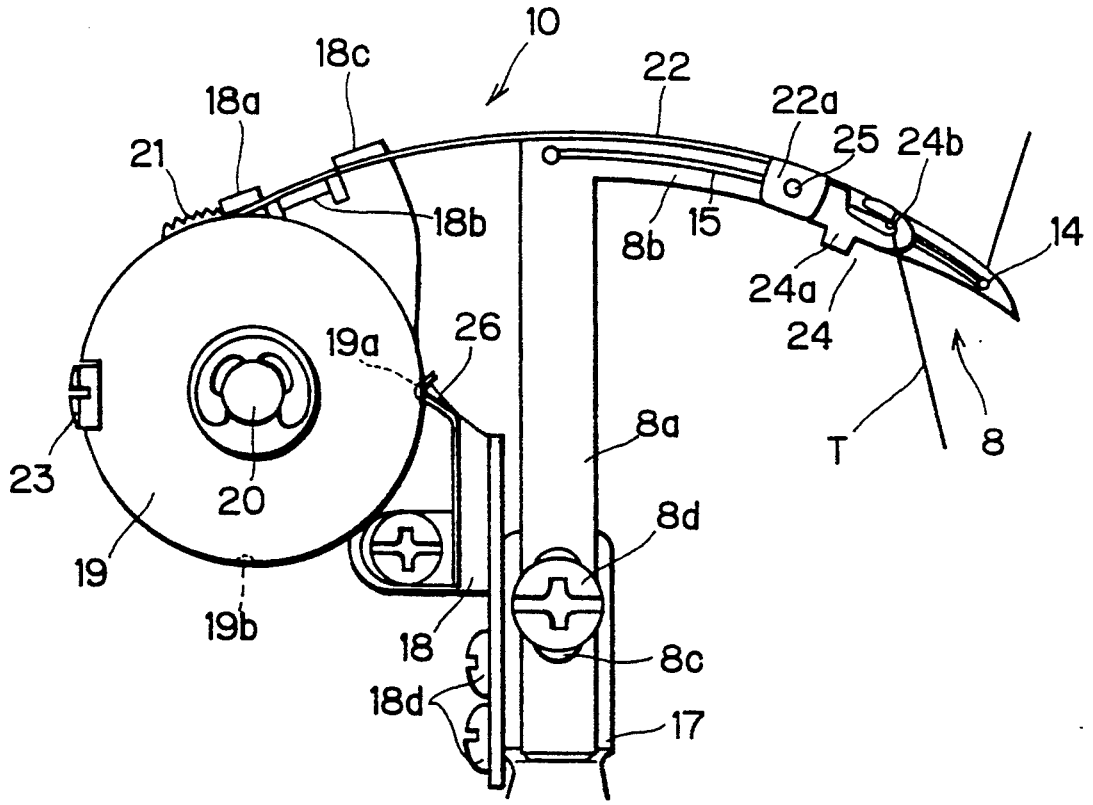
FIG. 1 is a front view showing an essential portion of a looper thread guiding mechanism whose movable segment is at a thread hooking or holding position according to one embodiment of the present invention.
Figure 2:
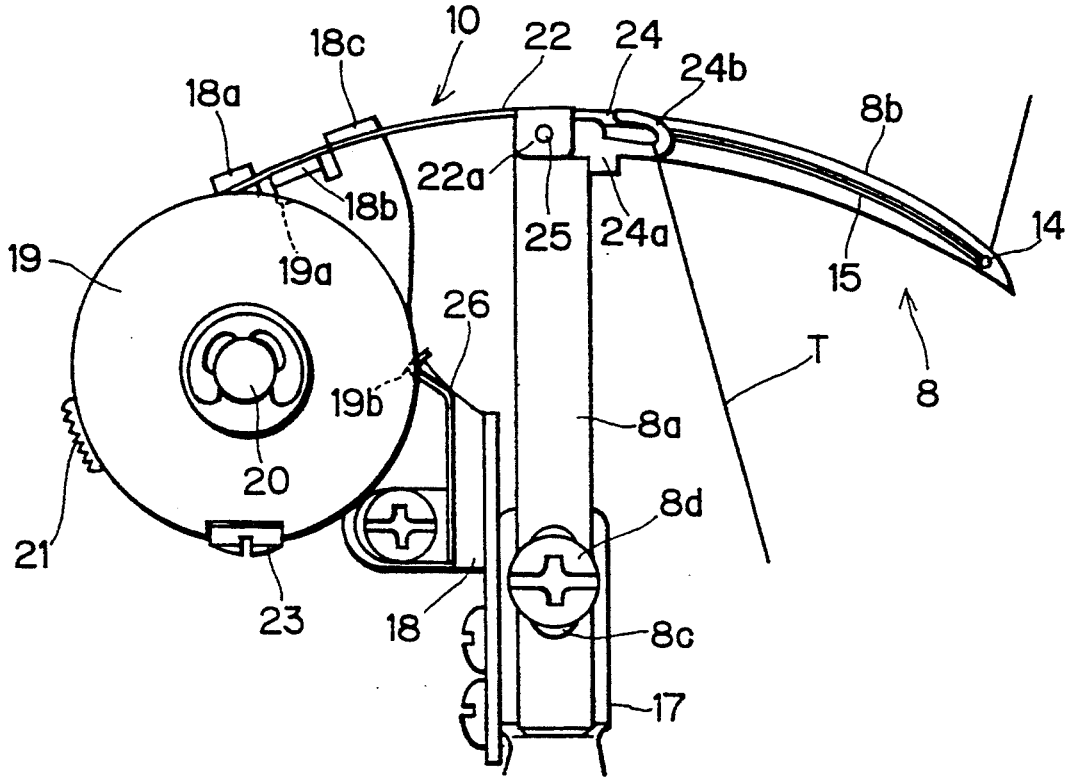
FIG. 2 is a front view showing an essential portion of the looper thread guiding mechanism whose movable segment is at a stitching position according to the embodiment of the present invention.

The looper thread guiding mechanism 10 provided at the double loop looper 8 will next be described with reference to FIGS. 1 through 4. As best shown in FIGS. 1 and 2, the double loop looper 8 includes a base member 8*a* extending in a vertical direction and an arm member or a sword-like member 8*b* extending from a tip end of the base member 8*a* in a direction perpendicular to the base member 8*a* and in a slightly arcuate fashion. A tip end portion of the sword-like member 8*b* has a thread hole 14. Further, one side face of the sword-like member 8*b* is formed with a thread guide groove 15 extending in a lengthwise direction thereof.

The double loop looper 8 is swingably and vertically position-adjustably provided. That is, the base member 8*a* has a lower portion formed with an elongated slot 8*c* through which a screw 8*d* extends. The screw 8*d* is threadingly engaged with a looper arm 17 fixedly coupled to a looper shaft 16 (see FIG. 5). Thus, upon rotation of the looper shaft 16, the looper 8 and the looper arm 17 are integrally pivoted in rightward/leftward direction in FIG. 1. The looper shaft 16 is drivingly connected to a manual operation pulley 27 (FIG. 5).

As shown in FIG. 2, the looper thread T passes through the thread hole 14, and is hooked with a hook portion or a thread holding portion (described later) positioned at a base end portion of the sword-like portion 8*b*. In this case, the looper thread T passing over the thread hole 14 extends along the thread guide groove 15. With this state, stitching is achievable. The looper thread guiding mechanism 10 is adapted for facilitating the setting of the looper thread T in a manner described above.

In the looper thread guiding mechanism 10, an attachment plate 18 is fixed to one side of the looper arm 17 by screws 18*d*. The attachment plate 18 extends upwardly from the looper arm 17 and has a front portion provided with a pin 20 about which a drum 19 is rotatably supported. The drum 19 is spaced away from the looper 8 (at left side of the base member 8*a* in FIG. 1). A diameter of an axially intermediate portion of the drum 19 is slightly smaller than those of axially end portions thereof, so that the drum 19 has a pulley-like configuration. At an outer peripheral surface portion of a rear side of the drum 19, an indentation or manipulating portion 21 is provided. No other mechanical components are disposed at a more deeper or rearward area of the rear side of the drum 19. Accordingly, when the side cover of the bed 2 is opened, an operator can easily access or manipulate the indentation 21.

A resilient linking member 22 is attached to the drum 19. The linking member 22 is formed of a leaf-spring material and has a web-like configuration having a small width. One end of the linking member 22 is connected to the outer peripheral surface of the drum 19 by a screw 23. A part of the linking member 22 is wound around the part of the outer peripheral surface of the drum 19, and the remaining part of the linking member 22 extends along the sword-like member 8*b*.

In order to provide such orientation of the resilient linking member 22, three guide segments 18*a*, 18*b* and 18*c* are provided at an upper portion of the attachment plate 18. Each of the guide segments 18*a*, 18*b*, 18*c* are bent in L-shape, and the bending portions thereof are arrayed so that the remaining portion of the linking member 22 can be oriented slightly upwardly in substantially parallelism with the sword-like member 8*b*. The linking member 22 is guided in contact with a lower surface of the guide segment 18*a*, an upper surface of the guide segment 18*b* and a lower surface of the guide segment 18*c* in order.

A tip end of the linking member 22 integrally provides a connecting segment 22*a* having an inverted U-shape configuration. The connecting segment 22*a* astrides the sword-like member 8*b*. Further, a movable segment 24 is slidably mounted on the sword-like member 8*b*. The movable segment 24 has a slidable section 24*a* having a U-shape cross-section. The slidable section 24*a* slidably engages the sword-like member 8*g* from below. Furthermore, a thread hook portion 24*b* is integrally provided to the slidable section 24*a* at a tip end side thereof. The thread hook portion 24*b* is positioned at the front side of the sword-like member 8*b* as best shown in FIG. 1. The connecting portion 22*a* of the connecting member 22 and the movable segment 24 are partially overlapped with each other at the front side of the sword-like member 8*b*, and are connected or force-fitted together by a pin 25.

Thus, if the drum 19 is rotated in one direction (counterclockwise direction in FIG. 1), the linking member 22 is wound over the drum 19 by about a half peripheral length thereof. Therefore, the movable segment 24 is slidingly moved along the sword like member 8*b* toward the base end portion thereof(leftwardly in FIG. 1). On the other hand, if the drum 19 is rotated in opposite direction (clockwise direction in FIG. 1), the linking member 22 is unwound from the drum 19, so that the movable segment 24 is moved toward the tip end portion of the sword-like member 8*b*.

Figure 3:
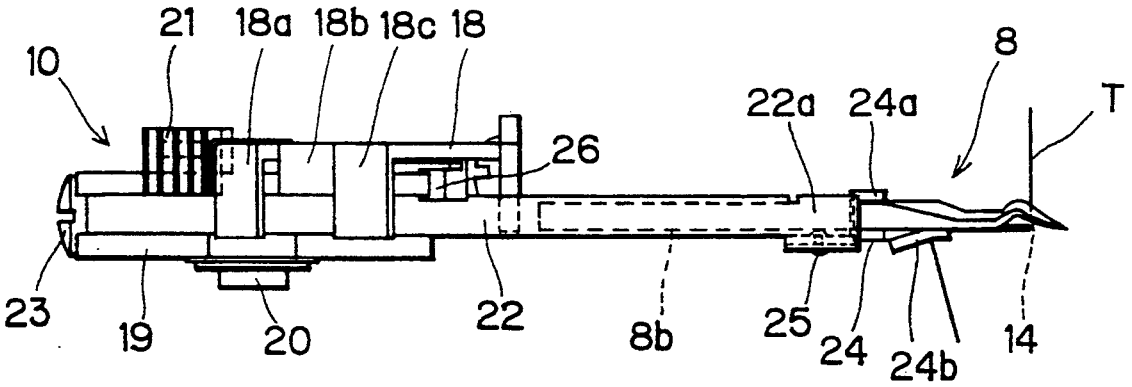
FIG. 3 is a top plan view in a state of FIG. 1.
Figure 4:
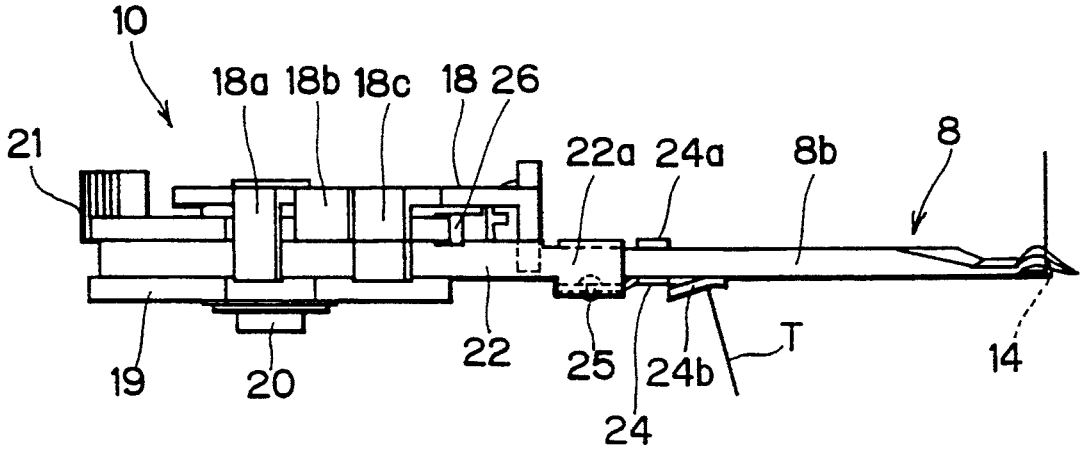
FIG. 4 is a top plan view in a state of FIG. 2.

Angular rotational range of the drum 19 is defined into a restricted range. That is, the movable range of the movable segment 24 is defined. A first ultimate position is a position where the manipulating portion 21 of the drum abuts the guide segment 18*a* as shown in FIGS. 1 and 3. A second ultimate position is a position where a part of the movable segment 24 abuts a one side (right side) of the base 8*a* of the looper 8 as shown in FIGS. 2 and 4. At the first ultimate position shown in FIGS. 1 and 3, the movable segment 24 is positioned adjacent to the thread hole 14 of the sword-like member 8*b* for providing a thread hooking position. In the second ultimate position shown in FIGS. 2 and 4, the movable segment 24 is positioned adjacent the base end portion of the sword-like member 8*b* to provide a stitching position.

The attachment plate 18 has a notched spring 26 at one side (right side in FIG. 1) of the drum 19. The notched spring 26 has a V-shaped bent portion at a free end thereof. Further, the rear or deep side of the drum 19 is formed with first and second recesses 19*a* and 19*b* at an outer peripheral surface thereof. The V-shaped bent portion of the notched spring 26 is normally urged toward the outer peripheral surface, and is engageable with the recesses 19*a*, 19*b*. As best shown in FIG. 1, if the movable segment 24 has the first ultimate position, the V-shaped bent portion is engaged with the first recess 19*a* so as to maintain angular rotational position of the drum 19 for holding the thread hooking position. On the other hand, as best shown in FIG. 2, if the movable segment 24 has the second ultimate position, the V-shaped bent portion is engaged with the second recess 19*b* so as to maintain the angular rotating position of the drum 19 for holding the stitching position.

Setting the looper thread T to the double loop looper 8 is performed as follows. The front and side covers at the bed 2 are opened, and the manual operation pulley 27 is operated to swing the double loop looper 8 in one direction (rightwardly in FIG. 5), so that the tip end of the sword-like portion 8*b* is brought to a position where handling to the looper thread and the looper is facilitated. Next, the manipulating portion 21 is operated to angularly rotate the drum 19, so that the movable segment 24 is moved to the thread hooking position. Here, the drum 19 is positioned away from the base member 8*a* and the sword like member 8*b* as well as other loopers 7 and 9. Therefore, an operator can easily manipulate the manipulating portion 21 for rotating the drum 19.

With this state, the looper thread T is inserted through the thread hole 14, and the thus inserted thread T is hooked at the thread hook portion 24*b* of the movable segment 24 as shown in FIGS. 1 and 3. In this case, since the hooking portion 24*b* is located adjacent to the thread hole 14, the thread hooking work can be easily performed. Incidentally, the looper thread T can be inserted through the thread hold 14 after the thread T is hooked at the hooking portion 24*b*.

Then, the manipulating portion 21 is again operated to rotate the drum 19 in the opposite direction so that the movable segment 24 is moved to the stitching position. Therefore, as shown in FIGS. 2 and 4, the looper thread T is guided to the base end portion of the sword-like member 8*b* therealong. Here, the rotation of the drum can be easily performed because of the easy access to the manipulating portion 21. Thereafter, the front and side covers of at the bed 2 are closed.

Thus, the looper thread T is positioned along the guide groove 15 after the thread is inserted through the hole 14, and the thread T is engaged at the thread hooking portion 24*b*, thereby completing thread setting. Consequently, stitching operation can be started.

In the above described embodiment, the movable segment 24 having the thread hooking portion 24*b* is provided slidably between the thread hooking position and the stitching position. Therefore, the hooking portion 24*b* is moved to a position close to the thread hole 14 for facilitating the thread setting operation. Then, the movable segment 24 is moved to the base end portion of the sword-like member 8*b* while the looper thread T is engaging with the hooking portion 24*b*. Accordingly, setting the looper thread to the double loop looper 8 can be easily achieved.

The drum 19 and the web like resilient linking member 22 are disposed in order to provide a substantially linear movement of the movable segment 24. Therefore, in contrast to the conventional looper thread guiding mechanism, no pivotal movement is required for the displacement of the thread hooking portion between the hooking position and the stitching position As a result, a compact installation space results, which in turn can provide a space for providing the drum 19 at a proper location where no mechanical interference occurs relative to the other loopers. Accordingly, desirable rotation of the drum 19 can be provided. Further, since the linking member 22 is of web like configuration, the linking member 22 can be disposed in a limited space where great numbers of mechanical components are disposed around the loopers 7, 8 and 9.

The above described advantages are particularly important in the looper thread guiding mechanism 10 to be used in conjunction with the double loop looper 8 around which other loopers such as the overlooper 7 and underlooper 9 are densely disposed along with other mechanical components in the bed 2 of the overlock sewing machine. Even in such intricate arrangement, the looper thread T can be easily set to all loopers 7, 8, 9 by the employment of the thread guiding mechanism relative to the double loop looper 8.

While the invention has been described in detail and with reference to specific embodiment thereof, it would be apparent to those skilled in the art that various changes and modifications may be made therein without departing from the spirit and scope of the invention. For example, in the above described embodiment, thread hooking portion 24 has a hook-shaped configuration for hooking the looper thread T. However, instead of the hook, a ring member is used for inserting the looper thread T thereinto for holding the looper thread T. Further, the thread guiding mechanism of the present invention can be applied to other kind of sewing machines having loopers as well as the overlock sewing machine.

What is claimed is:

1. A looper thread guiding mechanism for guiding a looper thread to a looper of a sewing machine, the looper including a base portion and an arm portion extending from the base portion and having a thread hole at its tip end portion, a stitch being formed in a workpiece by a swinging motion of the looper in synchronism with a vertical motion of a sewing needle, the mechanism comprising;

a movable segment slidably and substantially linearly movable along the arm portion between a thread hooking position adjacent the thread hole and a stitching position adjacent to the base portion, the movable segment having a thread holding portion;

a drum rotatably supported on the base portion and positioned away from the arm portion; and a linking member connected between the drum and the movable segment, the linking member being unwound from the drum upon angular rotation thereof in one direction for positioning the movable segment adjacent to the thread hole, and being partly wound over the drum upon angular rotation thereof in an opposite direction for positioning the movable segment adjacent to the base portion so as to guide the looper thread to the base portion.

2. The looper thread guiding mechanism as claimed in claim 1, wherein the arm portion of the looper extends substantially perpendicular to the base portion, the drum being positioned opposite the arm portion with respect to the base portion.

3. The looper thread guiding mechanism as claimed in claim 2, further comprising an attachment plate supported to the base portion at a position opposite the arm portion with respect to the base portion, the drum being rotatably supported by the attachment plate.

4. The looper thread guiding mechanism as claimed in claim 3, wherein the attachment plate comprises:

means for orienting the linking member along the arm portion when the drum is rotated in one direction and for orienting the linking member along the drum when the drum is rotated in the opposite direction.

5. The looper thread guiding mechanism as claimed in claim 4, wherein the base portion comprises a base member and a looper arm aligned colinearly therewith, the attachment plate being attached to the looper arm.

6. The looper thread guiding mechanism as claimed in claim 5, wherein the linking member is formed of a resilient web-like material and having one end fixed to the drum and another end slidably connected to the arm portion.

7. The looper thread guiding mechanism as claimed in claim 6, wherein the drum has one axial side face provided with a manipulating portion for angularly rotating the drum.

8. The looper thread guiding mechanism as claimed in claim 7, wherein the drum is formed with first and second recesses at an outer peripheral surface thereof, and wherein the attachment plate further comprises a resilient locking means selectively engageable with one of the first and second recesses for maintaining angular rotational position of the drum.

9. The looper thread guiding mechanism as claimed in claim 6, wherein the movable segment is connected to the another end of the linking member, the thread holding portion having a hook-like configuration.

10. The looper thread guiding mechanism as claimed in claim 9, wherein the arm portion of the looper has a sword-like configuration formed with an elongated groove along its length for directing the looper thread inserted through the thread hole toward the base portion.

* * * * *